US005448131A

United States Patent [19]

Taylor et al.

[11] Patent Number: 5,448,131

[45] Date of Patent: Sep. 5, 1995

[54] SPACER FOR FLAT PANEL DISPLAY

[75] Inventors: Robert H. Taylor, Richardson; Jules D. Levine, Dallas, both of Tex.

[73] Assignee: Texas Instruments Incorporated, Dallas, Tex.

[21] Appl. No.: 227,218

[22] Filed: Apr. 13, 1994

[51] Int. Cl.[6] ..... H01J 19/24; H01J 19/42

[52] U.S. Cl. ..... 313/309; 313/495; 313/250; 313/257; 313/256; 313/268; 313/292

[58] Field of Search ..... 313/309, 336, 351, 310, 313/355, 495, 496, 497, 250, 257, 268, 292, 253, 256; 315/169.4; 345/37–41, 47, 50, 60, 74, 75.74

[56] References Cited

U.S. PATENT DOCUMENTS

| | | | |
|---|---|---|---|
| 3,755,704 | 8/1973 | Spindt et al. | 313/309 |
| 4,091,305 | 5/1978 | Poley et al. | 313/220 |
| 4,099,082 | 7/1978 | Chodil et al. | 313/358 |
| 4,183,125 | 1/1980 | Meyer et al. | 29/25.15 |
| 4,422,731 | 12/1983 | Droguet et al. | 350/344 |
| 4,451,759 | 5/1984 | Heynisch | 313/495 |
| 4,940,916 | 7/1990 | Borel et al. | 313/306 |
| 5,063,327 | 11/1991 | Brodie et al. | 313/482 |
| 5,194,780 | 3/1993 | Meyer | 315/169.3 |
| 5,225,820 | 7/1993 | Clerc | 340/752 |
| 5,232,549 | 8/1993 | Cathey et al. | 313/309 X |
| 5,371,433 | 12/1994 | Horne et al. | 313/268 X |

*Primary Examiner*—Sandra L. O'Shea
*Assistant Examiner*—Ashok Patel
*Attorney, Agent, or Firm*—Christopher L. Maginniss; W. James Brady, III; Richard L. Donaldson

[57] ABSTRACT

A spacer 40 for use in a field emission device includes a comb-like structure having a plurality of elongated filaments 42 joined to a support member 44. The filaments 42, which may be glass, are positioned longitudinally in a single layer between the facing surfaces of the anode structure 10 and the electron emitting: structure 12. Support member 44 is positioned entirely outside the active regions of anode structure 10 and emitting structure 12. Spacer 40 provides voltage isolation between the anode structure 10 and the cathode structure 12, and also provides standoff of the mechanical forces of vacuum within the assembly. In a second embodiment, spacer 50 includes elongated filaments 52 joined at each end to a support member 54 *a* and 54*b,* the additional support facilitating handling, fabrication and assembly. In an additional embodiment, a filament 70 of nonuniform diameter contacts planar surfaces 74 and 76 only at the high spots 72 of filament 70, thereby reducing the shadowing of the beam on the display surface.

42 Claims, 1 Drawing Sheet

SPACER FOR FLAT PANEL DISPLAY

TECHNICAL FIELD OF THE INVENTION

The present invention relates generally to flat panel displays and, more particularly, to a spacer structure including elongated filaments for maintaining a fixed spacing between the emitter assembly and the display face of a substantially evacuated flat panel display.

BACKGROUND OF THE INVENTION

For more than half a century, the cathode ray tube (CRT) has been the principal electronic device for displaying visual information. The widespread usage of the CRT may be ascribed to the remarkable quality of the display characteristics in the realms of color, brightness, contrast and resolution. One major feature of the CRT permitting these qualities to be realized is the use of a luminescent phosphor coating on a transparent faceplate.

Conventional CRT's, however, have the disadvantage that they require significant physical depth, i.e., space behind the actual display surface, making them bulky and cumbersome. They are fragile and, due in part to their large vacuum volume, can be dangerous if broken. Furthermore, these devices consume significant amounts of power.

The advent of portable computers has created intense demand for displays which are lightweight, compact and power efficient. Since the space available for the display function of these devices precludes the use of a conventional CRT, there has been significant interest in efforts to provide satisfactory so-called "flat panel displays" or "quasi flat panel displays," having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these, displays provide poor contrast, only a limited range of viewing angles is possible, and, in color versions, they consume power at rates which are incompatible with extended battery operation. In addition, color screens tend to be far more costly than CRT's of equal screen size.

As a result of the drawbacks of liquid crystal display technology, thin film field emission display technology has been receiving increasing attention by industry. Flat panel displays utilizing such technology employs a matrix-addressable array of pointed, thin-film, cold field emission cathodes in combination with an anode comprising a phosphor-luminescent screen. Although the phenomenon of field emission was discovered in the 1950's, extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued Aug. 28, 1973, to C. A. Spindt et al.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robert Meyer; and U.S. Pat. No. 5,225,820, "Microtip Trichromatic Fluorescent Screen," issued Jul. 6, 1993, to Jean-Frédéric Clerc. These patents are incorporated by reference into the present application.

It is important in flat panel displays of the field emission cathode type that the electron emitting surface and the opposed display face be maintained insulated from one another at a relatively small but uniform distance throughout the full extent of the display face. There is a relatively high voltage differential, generally on the order of 300–1,000 volts, between the emitting surface and the display face, and it is vital that electrical breakdown between these two surfaces be prevented. However, the spacing between the two has to be small, typically on the order of 200 μmeters (microns), to assure that the desired thinness, high resolution and color purity are achieved. This spacing also has to be uniform for uniform resolution, brightness, to avoid display distortion, etc. Nonuniformity in spacing is much more likely to occur in a field emission cathode, matrix-addressed, flat vacuum-type display than in some other gas-filled display types, since there is typically also a high differential pressure on the opposite sides of the display face. Whereas the exposed side of such face may be at atmospheric pressure, a high vacuum of approximately $10^{-7}$ tort is generally applied between the emitting surface and the display face of the field emission flat panel display structure.

In general, spacer arrangements of the prior art for field emission-type cathode flat panel displays may be divided into two categories: spacer structures which are formed as an integral part of either the emitting structure or the anode structure, and those which are separate from both of these structures, and which are placed between the two during final assembly. In the former category, U.S. Pat. No. 4,857,799, "Matrix-Addressed Flat Panel Display," issued Aug. 15, 1989, to C. A. Spindt et al., describes a spacer approach in which elongated, parallel legs are provided integrally connected with the display face plate interspersed between adjacent rows of pixels. Another approach, disclosed in U.S. Pat. No. 4,091,305, "Gas Panel Space Technology," issued May 23, 1978, to N. M. Poley et al., for a gaseous discharge type of flat panel display, uses a metal to connect spacers, which metal is then coated with a dielectric layer. This approach is not conducive to being used in a field emission type arrangement, because of the high voltage differential necessary between the anode and cathodes of such an arrangement. This high voltage can exceed the breakdown potential of the dielectric and result in the metal of the spacer posts causing a voltage short between the faceplate and the cathode emitting surface.

Another approach in this category, disclosed in U.S. Pat. No. 4,422,731, "Display Unit With Half-Stud, Spacer, Connection Layer and Method of Manufacturing," issued Dec. 27, 1983, to J.-P. Drogeut et al., is to provide interacting spacer parts on the display face and the cathode construction. U.S. Pat. No. 4,451,759, "Flat Viewing Screen With Spacers Between Support Plates and Method of Producing Same," issued May 29, 1984, to H. Heynisch, shows such an arrangement for a flat panel display in which metal pins on the face register with hollow cylinders projecting from the cathode.

Finally, U.S. Pat. No. 5,063,327, "Filed Emission Cathode Based Flat Panel Display Having Polyimide Spacers," issued Nov. 5, 1991, to I. Brodie et al., discloses polyimide spacers or pillars separating the emitting surface an the display face of a flat panel display.

Many of these prior art approaches of the first-mentioned category have registration problems. All of them add a level of complexity to the fabrication of the cathode and/or anode structure, and all suffer from a performance disadvantage of interfering with the uniform flow of electrons between emitters and anode. It is known that electron beam trajectories avoid spacers shaped as elongated legs, or as cylindrical or rectangular pillars, of the types made of metal, plastic or glass, as disclosed in several prior art references. In these cases the beam cannot penetrate the spacers, and the legs or pillars are likely to be noticeable to a viewer of the display, appearing as dark areas on a luminescent screen.

In the latter category of prior art spacer arrangements, those which are separate from both the cathode structure and the anode structure, U.S. Pat. No. 4,183,125, "Method of Making an Insulator-Support for Luminescent Display Panels and the Like," issued Jan. 15, 1980, to R. L. Meyer et al., discloses a spacer comprising a stack of glass filaments, which are mutually bonded to form a unitary cellular latticework.

In another prior art method of this latter category known to the applicants, uniform spacing between a field emission structure arid an anode structure is provided by a multiplicity of glass spheres used as spacers between the cathode plate and the anode plate. These glass spheres, illustratively 200 microns in diameter, serve the dual purposes of providing voltage isolation between the plates, and also provide the standoff of the mechanical forces of vacuum on the two plates. The use of glass spheres as spacers provides a distinct advantage over the pillar structures of the prior art of the first-mentioned category cited above. This advantage is the relative invisibility of the glass spheres in the presence of an electron beam. The trajectory of the electron beam will tend to bend around and follow the circular shape of the spheres, minimizing the area of the display screen which is shadowed by the spacer.

However, there are problems associated with the use of glass spheres as spacers related to handling and assembly. During the fabrication processes of the flat panel display, just prior to assembly of the two halves of the display panel, glue is applied to the planar surface of the emission structure in spots. The spheres are added to the glued surface in excess. Some spheres become attached, the others must be removed, and the glue must be cured. This process can be difficult and time consuming. Similar assembly difficulties are presumed for the FIG. 3 embodiment of the Meyer et al. ('125) reference, comprising a single layer array of loose, unattached parallel filaments.

In view of the above, it is clear that there exists a need for an apparatus for maintaining a uniform spacing between the emission surface and the anode of a field emission flat panel display device which takes advantage of the relative invisibility of the glass spheres, but which lends itself to simpler fabrication processes.

SUMMARY OF THE INVENTION

In accordance with the principles of the present invention, there is disclosed herein apparatus comprising an electron emitter providing a substantially planar emitting surface, and an anode having a substantially planar face. The apparatus further comprises a comb-like structure having elongated filaments joined to a support member, the filaments positioned longitudinally between the emitting surface and the planar face so as to define a space between the electron emitter and the anode.

Further in accordance with the principles of the present invention, there is disclosed herein apparatus comprising an electron emitter providing a substantially planar emitting surface, and an anode having a substantially planar face. The apparatus further comprises a spacer comprising elongated filaments positioned longitudinally in a single layer between the emitting surface and the planar face so as to define a space between the electron emitter and the anode, the filaments being of nonuniform thickness to provide points of maximum thickness, the filaments contacting the emitting surface and the planar face at the points of maximum thickness.

In accordance with one embodiment of the present invention, the elongated filaments are joined to support members at both ends. In accordance with another embodiment of the present invention, the anode includes parallel stripes of a phosphorescent material which are not substantially parallel to the spacer filaments.

Still further in accordance with the principles of the present invention there is disclosed a method for fabricating an electronic display apparatus. The method comprises the steps of providing a substrate having ant array of field emission cathodes at a substantially planar emitting surface, and providing a display panel including an anode having a substantially planar face. The method further comprises the steps of positioning a comb-like structure having elongated filaments joined to a support member between the emitting surface and the planar face, the filaments positioned longitudinally so as to define a space between the substrate and the display panel, and sealing the substrate to the display panel.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
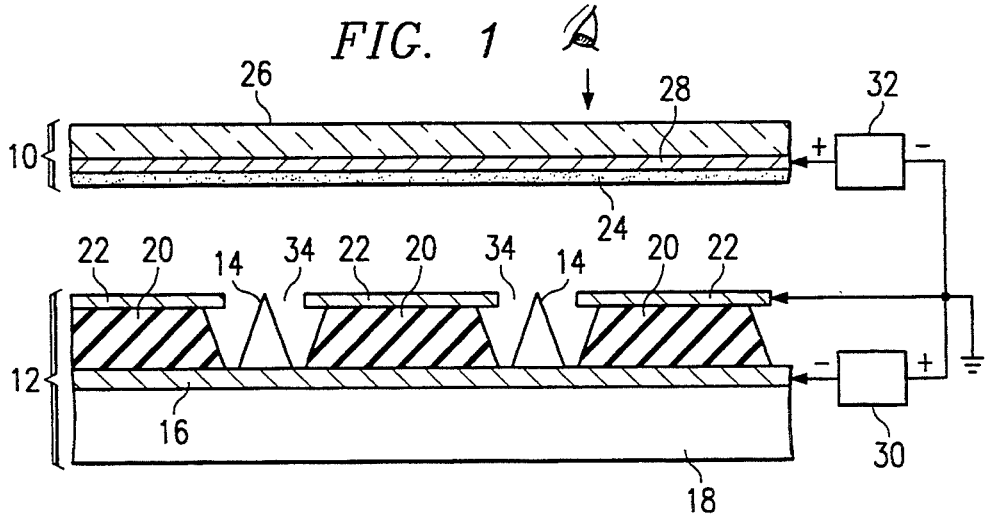
FIG. 1 is a cross-sectional view of a portion of a field emission device in which the present invention may be incorporated.

Referring initially to FIG. 1, there is shown, in cross-sectional view, a portion of an illustrative field emission flat panel display device in which the present invention may be incorporated. In this embodiment, the field emission device comprises an anode portion having an electroluminescent phosphor coating facing a cathode portion, the phosphor coating being observed from the side opposite to its excitation.

More specifically, the field emission device of FIG. 1 comprises a cathodoluminescent anode 10 and a cathode 12. Cathode 12 comprises a plurality of electrically conductive microtips 14 formed on an electrically conductive coating 16, which is itself formed on an electrically insulating substrate 18. Coating 16 may be semiconducting or resistive instead of being conducting.

A gate electrode comprises a coating of an electrically conductive material 22 which is deposited on an insulating layer 20. Microtips 14 take the shape of cones which are formed within apertures through conductive layer 22 and insulating layer 20. The thicknesses of gate electrode coating 22 and insulating layer 20 are chosen in such a way that the apex of each microtip 14 is substantially level with the electrically conductive gate electrode coating 22. Conductive coating 22 may be in the form of a continuous coating across the surface of substrate 18; alternatively, it may comprise conductive bands across the surface of substrate 18.

Anode 10 comprises an electrically conductive film 28 deposited on a transparent planar support 26 which is positioned facing gate electrode 22 and parallel thereto, the conductive film 28 being deposited on the surface of support 26 directly facing gate electrode 22. Conductive film 28 may be in the form of a continuous coating across the surface of support 26; alternatively, it may be in the form of electrically isolated stripes comprising three series of parallel conductive bands across the surface of support 26, as taught in U.S. Pat. No. 5,225,820, to Clerc. By way of example, a suitable material for use as conductive film 28 may be indium-tin-oxide (ITO), which is optically transparent and electrically conductive. Anode 10 also comprises a cathodoluminescent phosphor coating 24, deposited over conductive film 28 so as to be directly facing and immediately adjacent gate electrode 22. In the Clerc patent, the conductive bands of each series are covered with a phosphor coating which luminesces in one of the three primary colors, red, blue and green. A preferred process for applying phosphor coating 24 to conductive film 28 comprises electrophoretic deposition.

One or more microtip emitters 14 of the above-described structure are energized by applying a negative potential on coating 16, functioning as the cathode electrode, relative to the gate electrode 22, via voltage supply 30, thereby inducing an electric field which draws electrons from the apexes of microtips 14. The freed electrons are accelerated toward the anode portion 10 which is positively biased by the application of a substantially larger positive voltage from voltage supply 32 coupled between the gate electrode 22 and conductive film 28 functioning as the anode electrode. Energy from the electrons attracted to the anode conductive film 28 is transferred to local molecules of the phosphor coating 24, resulting in luminescence. The electron charge is transferred from phosphor coating 24 to conductive film 28, completing the electrical circuit to voltage supply 32.

Holes 34 made in the conductive coating 22 may have an illustrative diameter of 1.3 microns. The diameter of hole 34 through conductive coating 22 and the thicknesses of gate electrode coating 22 and insulating layer 20 determine the size of the microtip 14 formed therein. Microtips 14 are illustratively spaced frown one another by 3.0 microns. Microtips 14 may be clustered in arrays, illustratively arranged as matrices comprising four-by-four or five-by-five tips, wherein the arrays may illustratively be spaced at a pitch of 25 microns. As mentioned earlier, cathode 12 and anode 10 are illustratively spaced from each other by 200 microns. The voltage which causes field emission from microtips 14, i.e., the gate-to-cathode voltage from supply 30, may illustratively be 70 volts, while the voltage which accelerates the freed electrons toward the anode, i.e., the anode-to-gate voltage from supply 32, may illustratively be 300–1,000 volts.

Figure 2:
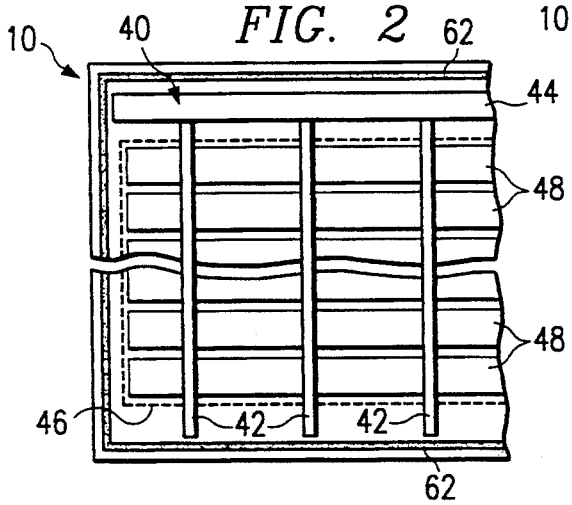
FIG. 2 illustrates a spacer for use in the field emission device of FIG. 1 in accordance with a first embodiment.

Referring now to FIG. 2, there is shown a spacer 40 for use in the field emission device of FIG. 1 in accordance with a first embodiment employing the principles of the present invention. Spacer 40 comprises a comb-like structure having a plurality of elongated filaments 42 joined to a support member 44. As used herein, the term "filament" means the individual fibers, threads, rods, strands, strings or canes which provide the spacing function between the opposed faces of anode structure 10 and emitting structure 12.

Spacer 40 is shown in this illustration positioned against anode structure 10 such that it lies entirely within the periphery of structure 10, but in such a way that only filaments 42 extend over the active region 46, i.e., the region including the phosphorescent coating. If spacer 40 were to be shown positioned against electron emitting structure 12, it would lie entirely within the periphery of structure 12, but in such a way that only filaments 42 would extend over the active region of that device, i.e., the region including microtip emitters 14.

In this embodiment, filaments 42 are all of substantially equal diameter and have a substantially uniform cross-section over that portion of their length spanning the active region 46 of anode structure 10. In accordance with the dimensions recited above, the thickness of filaments measured across the points of contact with emitter structure 12 and anode structure 10 is 200 microns. By way of example, the cross section of filaments 42 may be circular. Further by way of example, filaments 42 may be substantially equally spaced from one another, the spacing being on the order of 5–30 millimeters.

The material from which filaments 42 are fabricated must have the following qualifies. It must be electrically insulating, capable of withstanding a potential difference of approximately 1,000 volts in the application directed to its intended use as described herein. Second, it must have sufficient compressive strength to withstand the force exerted by anode structure 10 against cathode structure 12 in the presence of a vacuum. Third, it must be sufficiently ductile as to survive handling and assembly operations. Finally, it must be substantially free from outgassing when a vacuum pressure of approximately $10^{-7}$ torr. The third quality practically dictates that the material of filaments 42 must be inorganic. In the present example, glass is considered the most advantageous material for use as filaments 42.

In the example illustrated by FIG. 2, filaments 42 are aligned substantially perpendicular to anode stripes 48 in order to minimize the shadowing of a particular stripe by the electron beam. In the preferred embodiment, filaments 42 are arranged such that they are not substantially parallel to anode stripes 48.

Support member 44 may comprise the same material as filaments 42. The only limitations on the physical dimensions of support member 44 are that its thickness must be such that it does not affect to the spacing function provided by filaments 42, and it must be sufficiently small that it can be positioned entirely in the peripheral area of anode structure 10, i.e., outside the active region 46 including anode stripes 48, or entirely in the peripheral area of emitting structure 12, i.e., outside the active region including the electron emitting microtips (not shown), while remaining within the region enclosed by sealing material 62.

Figure 3:
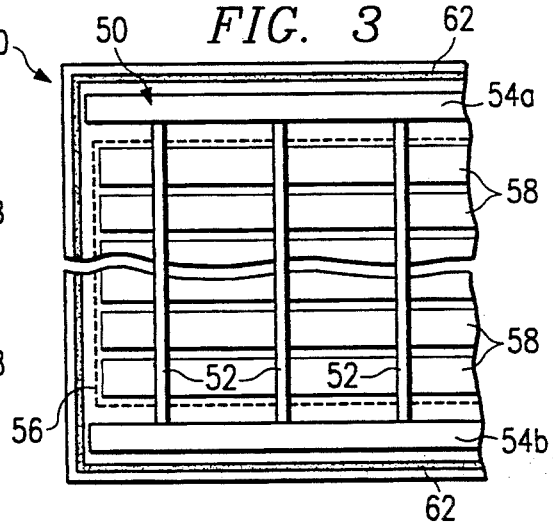
FIG. 3 illustrates a spacer for use in the field emission device of FIG. 1 in accordance with a second embodiment.

Referring now to FIG. 3, there is shown a spacer 50 for use in the field emission device of FIG. 1 in accordance with a second embodiment of the present invention. Spacer 50 comprises a plurality of elongated filaments 52 each joined at one end to a first support member 54*a* and at the other end to a second support member 54*b*. Filaments 52 may be in all other respects identical to filaments 42 of FIG. 2. The additional support for filaments 52 in this embodiment facilitates handling and maintains a more uniform spacing between filaments 52 during the assembly processes. In this embodiment, spacers 54*a* and 54*b* must be of a size such that both can be positioned entirely in the peripheral area of anode structure 10, i.e., outside the active region 56 including anode stripes 58, or entirely in the peripheral area of emitting structure 12, i.e., outside the active region including the electron emitting microtips (not shown), while remaining within the region enclosed by sealing material 62.

Figure 4:
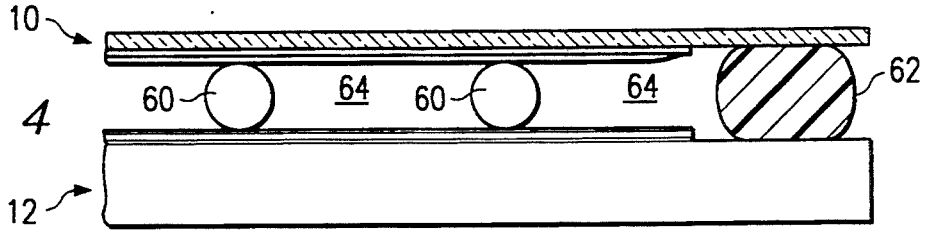
FIG. 4 is a cross-sectional view of a portion of an assembled field emission device including the spacer of the present invention.

Referring now to FIG. 4, there is shown a cross-sectional view of a portion of an assembled field emission flat panel display including the spacer of the present invention. The display includes an anode structure 10 and a cathode structure 12, both being of the types described in greater detail in previous paragraphs relating to FIG. 1. These two structures 10, 12 are spaced from one another by filaments 60, which may be of the type described in relation to the embodiments of FIGS. 2 and 3.

Anode structure 10 and cathode structure 12 are sealed together at peripheral portions thereof by sealing material 62, which may illustratively comprise a glass frit rod, which reflows at a temperature below the reflow temperature of filaments 60. The reflow temperature of sealing material 62 may be in the range of approximately 400–450° C.

The sealing process occurs in an environment of an inert gas, preferably argon. After the sealing process, the space 64 between anode structure 10 and cathode structure 12 is evacuated to a pressure of approximately $10^{-7}$ tore through an opening (not shown) in either emitter structure 12 or the structure 10.

It will be recognized that spacer 40 of the FIG. 2 embodiment, having a single support member 44, provides advantageous ease of evacuation, as the space between anode display panel 10 and emitter structure 12 is a single labyrinthine compartment. It will be further recognized that spacer 50 of the FIG. 3 embodiment, having two support members 54*a* and 54*b*, provides advantageous ease of handing, due to its enhanced structural support.

Figure 5:
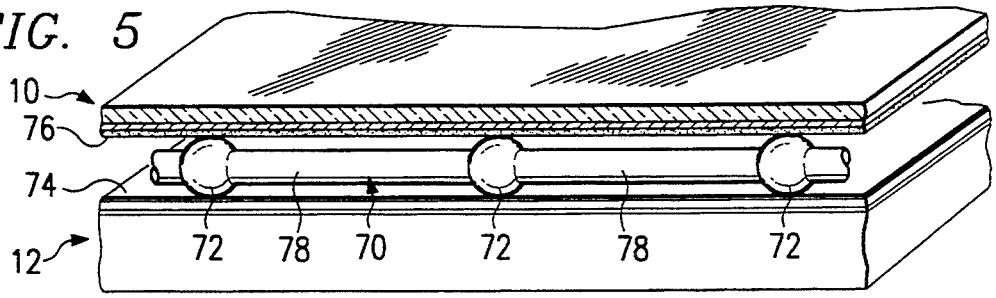
FIG. 5 illustrates a spacer filament for use in the field emission device of FIG. 1 in accordance with an additional embodiment.

Referring now to FIG. 5, there is illustrated a spacer filament 70 for use in the field emission device of FIG. 1 in accordance with an additional embodiment of the present invention. In the cases of spacer filaments 42 and 52 of uniform diameter, such as are shown in FIGS. 2 and 3, respectively, the contact between the filament and the planar surface is a line. However, where a spacer includes a filament 70 having nonuniform diameters along its length, as shown in FIG. 5, the contacts with the planar surfaces 74 and 76 comprise a series of points at the high spots 72 of the filament 70. In order to provide uniform spacing over the entire range of surfaces 74 and 76, it will be recognized that the diameters of all high spots 72 of all filaments 70 must be substantially equal. It is estimated that an adequate spacing function would be provided by sphere-like structures 72, having diameters of 200 microns, which are serially connected by rod-like structures 78 having nominal diameters of between 100–180 microns (not a critical dimension), wherein structures 72 are spaced apart by approximately 5–30 millimeters.

Filament 70, as illustrated in FIG. 5, comprises, in essence, a sequence of substantially spherical objects 72 serially coupled by substantially cylindrical rods 78 whose diameters are less than the diameters of spheres 72. While this "dumbbell" structure may be the most advantageous, the applicants recognize that filament 70 may assume any of several distinctive forms while serving to provide spacing between two planar structures at discrete points. These forms also include, but are not limited to, a barbell structure, a string-of-pearls arrangement, and many other forms of recess into a rod-like structure including rippling, fluting and scalloping.

The benefit of using nonuniform-diameter filaments 70 as spacers is that there is clearly less shadowing of the electron beam on the display surface, since there is significantly reduced contact between the spacer element 70 and either of the planar surfaces 74 and 76. The manufacture of such a nonuniform-diameter filament 70 is a relatively simple and well understood concept involving extrusion of the filament material at fluctuating speeds.

In accordance with the principles of the present invention, a method for fabricating an electronic display apparatus comprises the steps which follow. A substrate is provided having an array of field emission cathodes at a substantially planar emitting surface, which may be of the type described in relation to FIG. 1. A display panel is provided which includes an anode having a substantially planar face, which may also be of the type described in relation to FIG. 1. Both the substrate and the display panel have peripheral areas surrounding the active regions of their respective planar surfaces. A spacer comprising a comb-like structure is provided which has elongated filaments joined to a support member. The spacer may be any one of the types described in relation to FIGS. 2, 3 or 5. A seal is provided which may comprise glass flit rod preformed to an appropriate shape and size such as to serve as a gasket.

Either the emitter substrate or the anode display panel is placed in a chamber with its active region facing upward; in this example, the anode display panel will serve as this device. The spacer is positioned on the anode display panel with the filaments over the active region and the support member entirely in the peripheral area. The seal is placed on the peripheral area of the anode display panel, entirely enclosing the spacer within its bounds. The remaining structure, the emitter substrate in this example, is placed in the chamber which is filled with an inert gas, illustratively argon, at approximately atmospheric pressure.

Heat is then applied until the contents have stabilized at a temperature of approximately 450° C., which temperature is selected as one which will cause the glass frit rod seal to reform but will not affect the shape of the spacer filaments. The emitter substrate is placed on the display panel/spacer/seal assembly, with its active region facing down, and positioned such that its active region is over the spacer filaments, and the spacer support member and the seal are both entirely under the peripheral area of the emitter substrate. A steady downward force is applied on this assembly, illustratively between approximately 10 and 50 pounds depending on the areas of the anode and emitting structures, which force tends to compress the seal.

The temperature of approximately 450° C. is held for approximately five minutes, and the assembly is then permitted to cool, while maintaining pressure on the two halves of the assembly. When cooled, the compressive force is removed and the gas is evacuated from the space between the substrate and the display panel by pumping it to a pressure of approximately $10^{-7}$ torr. Finally, the port through which the gas has been evacuated is sealed.

A field emission flat panel display device which includes the spacers disclosed herein, and a method of assembling a field emission flat panel display device which includes the spacers disclosed herein, overcome many limitations and disadvantages of the prior art display devices and methods. The relatively simple structure of the spacer of the present invention is far easier to fabricate than the latticework, pillar and leg structures of the prior art, and it is easier to handle and assemble than the prior art method involving the multiplicity of individual spheres.

The spacer of the present invention provides advantages over the pillar and leg structures of the prior art, in that, due to its generally circular aspect, it is relatively invisible in the presence of an electron beam, particularly the embodiment illustrated in FIG. 5. The trajectory of the electron beam will tend to bend around its circular shape, minimizing the area of the display screen which is shadowed by the spacer.

Hence, for the application to flat panel display devices envisioned here, the approach in accordance with the present invention provides significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. Apparatus comprising:

an electron emitter assembly having a substantially planar surface;

an electron collector assembly having a substantially planar face; and a spacer structure comprising at least a first support member and elongated filaments each filament joined at one end thereof to said support member, said filaments positioned between said emitter assembly planar surface and said collector assembly planar face so as to define a space between said electron emitter assembly and said electron collector assembly.

2. The apparatus in accordance with claim 1 wherein said filaments have substantially equal maximum thicknesses.

3. The apparatus in accordance with claim 2 wherein said filaments are of substantially uniform thickness.

4. The apparatus in accordance with claim 2 wherein said filaments have generally circular cross sections.

5. The apparatus in accordance with claim 4 wherein said filaments have generally uniform diameters.

6. The apparatus in accordance with claim 2 wherein said filaments are of nonuniform thickness to provide points of maximum thickness, said filaments contacting said emitter assembly planar surface and said collector assembly planar face at said points of maximum thickness.

7. The apparatus in accordance with claim 1 wherein said filaments comprise a material which is substantially free from outgassing when subject to a vacuum of approximately $10^{-7}$ torr.

8. The apparatus in accordance with claim 1 wherein said filaments comprise an inorganic material.

9. The apparatus in accordance with claim 1 wherein said filaments comprise glass.

10. The electronic display apparatus in accordance with claim 1 wherein said support member comprises glass.

11. The apparatus in accordance with claim 1 wherein said filaments are substantially parallel to one another.

12. The apparatus in accordance with claim 1 wherein said spacer structure further includes a second support member spaced apart from said first support member, said filaments being positioned between said first and second support members and joined thereto.

13. The apparatus in accordance with claim 12 wherein said filaments and said support members comprise glass.

14. An electron emission apparatus comprising:

an electron emitter assembly having a substantially planar surface;

an electron collector assembly having a substantially planar face; and a spacer structure comprising at least a first support member and elongated filaments, each filament joined at one end thereof to said support member, said filaments arranged in a single layer between said electron emitter assembly planar :surface and said electron collector assembly planar face so as to define a space between said electron emitter assembly and said electron collector assembly, said filaments being of nonuniform thickness to provide points of maximum thickness, said filaments contacting said emitter assembly planar surface and said collector assembly planar face at said points of maximum thickness.

15. The apparatus in accordance with claim 14 wherein said filaments have generally circular cross sections with nonuniform diameters.

16. The apparatus in accordance with claim 15 wherein said points of maximum thickness comprise points of maximum diameter, all of said filaments having substantially equal maximum diameters.

17. The apparatus in accordance with claim 14 wherein said filaments comprise a sequence of generally spherical structures of substantially equal diameter, said spherical structures serially coupled by substantially cylindrical rods having diameters which are less than the diameter of said spheres.

18. The apparatus in accordance with claim 14 wherein said filaments comprise a material which is substantially free frown outgassing when subject to a vacuum of approximately $10^{-7}$ torr.

19. The apparatus in accordance with claim 14 wherein said filaments comprise an inorganic material.

20. The apparatus in accordance with claim 14 wherein said filaments comprise glass.

21. The apparatus in accordance with claim 14 wherein said filaments are substantially parallel to one another.

22. The apparatus in accordance with claim 14 wherein said spacer structure further includes a second support member spaced apart from said first support member, said filaments being positioned between said first and second support members and joined thereto.

23. The apparatus in accordance with claim 22 wherein said filaments and said support members comprise glass.

24. An electronic display apparatus comprising:

a substrate including an array of field emission cathodes, said substrate providing a substantially planar emitting surface;

a display panel including an anode having a substantially planar face opposing said surface;

a spacer structure comprising at least a first support member and elongated filaments, each filament joined at one end thereof to said support member, said filaments positioned between said emitting surface and said planar face so as to define a space between said substrate and said display panel; and means for sealing said substrate to said display panel to maintain a vacuum in said space.

25. The electronic display apparatus in accordance with claim 24 wherein said filaments are of substantially uniform thicknesses.

26. The electronic display apparatus in accordance with claim 24 wherein said filaments are of nonuniform thickness to provide points of maximum thickness, said filaments contacting said emitting surface and said planar face at said points of maximum thickness.

27. The electronic display apparatus in accordance with claim 24 wherein said filaments have generally circular cross sections.

28. The electronic display apparatus in accordance with claim 27 wherein said filaments are of nonuniform diameters to provide points of maximum diameter, said filaments contacting said emitting surface and said planar face at said points of maximum diameter.

29. The electronic display apparatus in accordance with claim 27 wherein said filaments have generally uniform diameters.

30. The electronic display apparatus in accordance with claim 24 wherein said filaments comprise a material which is substantially free of outgassing when subjected to a vacuum of approximately $10^{-7}$ torr.

31. The electronic display apparatus in accordance with claim 24 wherein said filaments comprise an inorganic material.

32. The electronic display apparatus in accordance with claim 24 wherein said filaments comprise glass.

33. The electronic display apparatus in accordance with claim 32 wherein said support member comprises glass.

34. The electronic display apparatus in accordance with claim 24 wherein said filaments are substantially parallel to one another.

35. The electronic display apparatus in accordance with claim 24 wherein said spacer structure further includes a second support member spaced apart from said first support member, said filaments being positioned between said first and second support members and joined thereto.

36. The electronic display apparatus in accordance with claim 35 wherein said filaments and said support members comprise glass.

37. The electronic display apparatus in accordance with claim 24 further including a layer of an electroluminescent material on said anode planar face.

38. The electronic display apparatus in accordance with claim 37 wherein said layer of an electroluminescent material on said anode planar face is in the form of substantially parallel stripes.

39. The electronic display apparatus in accordance with claim 38 wherein said stripes of electroluminescent material are not substantially parallel to said filaments.

40. The electronic display apparatus in accordance with claim 37 wherein said electroluminescent material comprises a phosphor.

41. The electronic display apparatus in accordance with claim 24 wherein said means for sealing said substrate to said display panel comprises a glass frit rod.

42. The electronic display apparatus in accordance with claim 41 wherein said glass frit rod is deformed in its cross section.

* * * * *